US010179460B2

(12) United States Patent
Yamamoto

(10) Patent No.: US 10,179,460 B2
(45) Date of Patent: Jan. 15, 2019

(54) LIQUID JETTING APPARATUS

(71) Applicant: BROTHER KOGYO KABUSHIKI KAISHA, Nagoya-shi, Aichi-ken (JP)

(72) Inventor: Hideki Yamamoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/711,821

(22) Filed: Sep. 21, 2017

(65) Prior Publication Data

US 2018/0093478 A1 Apr. 5, 2018

(30) Foreign Application Priority Data

Sep. 30, 2016 (JP) ..... 2016-193699

(51) Int. Cl.
*B41J 2/175* (2006.01)
*B41J 29/13* (2006.01)

(52) U.S. Cl.
CPC ..... *B41J 2/17553* (2013.01); *B41J 2/1752* (2013.01); *B41J 2/17503* (2013.01); *B41J 2/17509* (2013.01); *B41J 29/13* (2013.01)

(58) Field of Classification Search
CPC .. B41J 2/17553; B41J 2/17503; B41J 2/1752; B41J 2/17509; G03G 21/1633; G03G 2221/169
See application file for complete search history.

(56) References Cited

U.S. PATENT DOCUMENTS

2009/0256884 A1* 10/2009 Aoki ..... B41J 2/1721 347/23
2013/0063532 A1 3/2013 Takata et al.

FOREIGN PATENT DOCUMENTS

JP H11-330725 A 11/1999
JP 2012-051328 A 3/2012
JP 2013-056508 A 3/2013

* cited by examiner

*Primary Examiner* — Geoffrey S Mruk
(74) *Attorney, Agent, or Firm* — Merchant & Gould P.C.

(57) ABSTRACT

A liquid jetting apparatus includes: a liquid jetting unit configured to jet liquid; a casing including a tank storing part in which a tank containing the liquid to be supplied to the liquid jetting unit is stored, and having an opening through which the tank storing part communicates with an outside of the casing; a cover pivotally attached to the casing and selectively positioned in a closed position and an opened position; a moving member movably attached to the casing and including an engaging part configured to engage with the cover in the closed position to prevent pivoting of the cover; and a movement mechanism configured to move the moving member relative to the casing between an engagement position where the engaging part is engaged with the cover in the closed position and a release position where the pivoting of the cover is not prevented.

12 Claims, 5 Drawing Sheets

LIQUID JETTING APPARATUS

CROSS REFERENCE TO RELATED APPLICATION

The present application claims priority from Japanese Patent Application No. 2016-193699 filed on Sep. 30, 2016, the disclosure of which is incorporated herein by reference in its entirety.

BACKGROUND

Field of the Invention

The present invention relates to a liquid jetting apparatus including a liquid jetting unit and a casing provided with a tank storing part in which a tank containing liquid to be supplied to the liquid jetting unit is stored.

Description of the Related Art

There is conventionally known a recording apparatus having a casing in which a cartridge installing part (tank storing part) is formed. The casing has an opening that allows the cartridge installing part to communicate with the outside of the casing. The casing is provided with a cover pivotally attached thereto and selectively positioned in a closed position where the opening is closed and in an opened position where the opening is open. The cover is kept in the closed position by engaging a claw formed in an end surface of the cover with an engaging part formed in an edge of the opening of the casing.

SUMMARY

When foreign matter, such as dust, enters the tank storing part from the outside of the casing through the opening, the foreign matter may adhere to a liquid inlet of a tank and/or enter a liquid channel leading from the tank to a liquid jetting unit. This may cause a failure in liquid jetting of the liquid jetting unit. Further, the liquid may leak from the tank storing part to the outside of the casing through the opening. The above recording apparatus has solved these problems by engaging the claw of the cover in the closed position with the engaging part of the casing. In that configuration, however, engagement between the claw of the cover and the engaging part of the casing may make the pivoting of the cover difficult.

An object of the present teaching is to provide a liquid jetting apparatus that can prevent the entrance of foreign matter and liquid leakage through an opening and facilitate pivoting of a cover.

According to an aspect of the present teaching, there is provided a liquid jetting apparatus, including: a liquid jetting unit configured to jet liquid; a casing including a tank storing part in which a tank containing the liquid to be supplied to the liquid jetting unit is stored, and having an opening through which the tank storing part communicates with an outside of the casing; a cover pivotally attached to the casing and selectively positioned in a closed position where the opening is closed and an opened position where the opening is open; a moving member movably attached to the casing and including an engaging part configured to engage with the cover in the closed position to prevent pivoting of the cover; and a movement mechanism configured to move the moving member relative to the casing between an engagement position where the engaging part is engaged with the cover in the closed position to prevent the pivoting of the cover and a release position where the pivoting of the cover is not prevented.

According to the aspect of the present teaching, engaging the engaging part with the cover in the closed position can prevent the entrance of foreign matter and liquid leakage through the opening. Further, allowing the movement mechanism to move the moving member from the engagement position to the release position facilitates the pivoting of the cover.

DESCRIPTION OF THE EMBODIMENTS

First Embodiment

Figure 1:
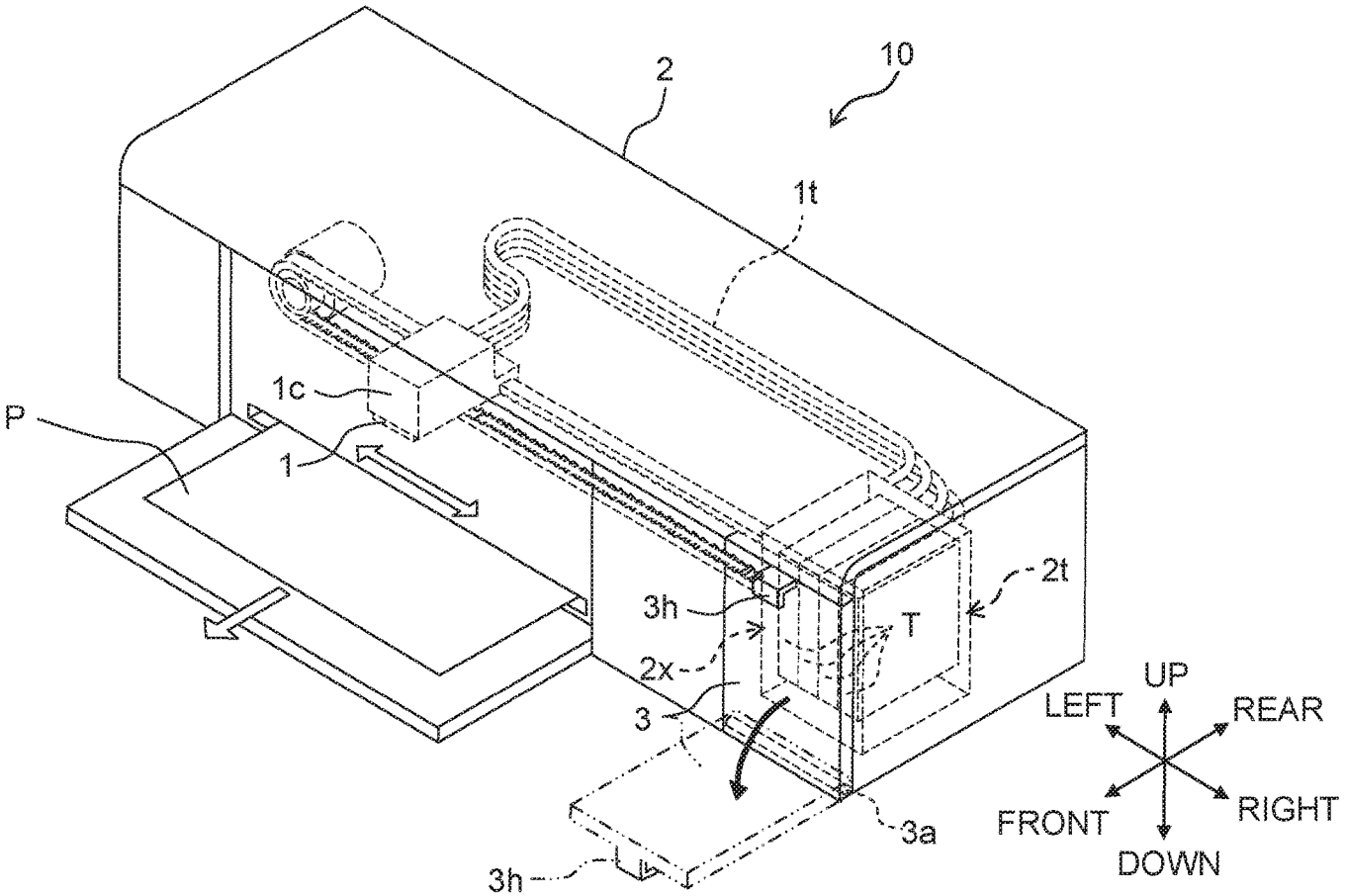
FIG. 1 is a perspective view of a printer according to a first embodiment of the present teaching.

Referring to FIG. 1, an overall configuration of a printer 10 according to the first embodiment of the present teaching will be explained.

The printer 10 includes a head 1 and a casing 2.

The head 1 includes jetting ports (not depicted) through which inks are jetted. Any one of cyan, magenta, yellow, and black inks is jetted from each jetting port. The head 1 carried by a carriage 1*c* jets each ink from each jetting port while reciprocating in a left-right direction, thus forming an image on a sheet P that is conveyed from a rear side to a front side by a conveyance mechanism (not depicted).

The casing 2 includes a tank storing part 2*t* that stores four cartridge-type tanks T. Each of the tanks T contains the corresponding one of the four inks to be supplied to the head 1. The tanks T stored in the tank storing part 2*t* communicate with the head 1 via tubes 1*t*. A front side surface of the casing 2 is formed with an opening 2*x* that allows the tank storing part 2*t* to communicate with the outside of the casing 2.

A cover 3 is attached to a part of the casing 2 formed with the opening 2*x*. The cover 3 is pivotally attached to the casing 2 with a pivoting shaft 3*a* as a pivoting center. The cover 3 may selectively be positioned in a closed position (a position depicted by a solid line in FIG. 1) in which the opening 2*x* is closed with the cover 3 and in an opened position (a position depicted by a broken line in FIG. 1) in which the opening 2*x* is open. The pivoting shaft 3*a*, which is disposed below the opening 2*x*, extends in the left-right direction. A handle 3*h* is provided in an upper portion of an outer surface of the cover 3. A user may open and close the cover 3 by holding the handle 3*h*.

Figure 2:
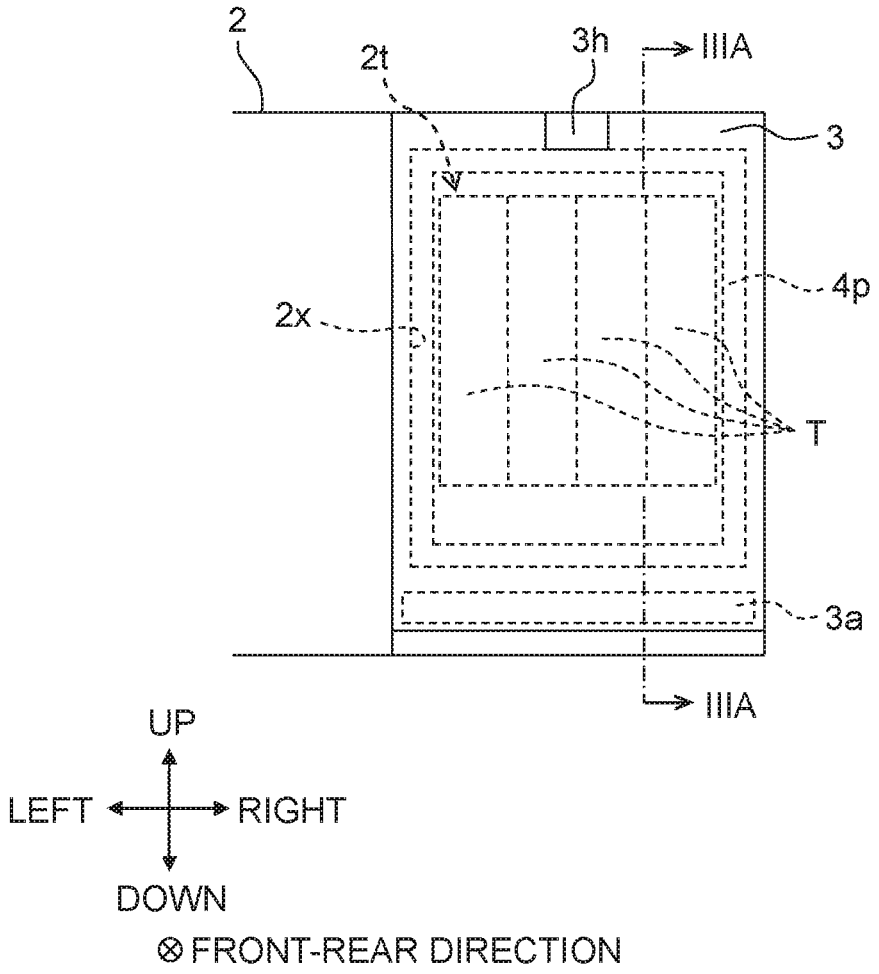
FIG. 2 is a side view of a part, of a casing of the printer, provided with a cover.
Figure 3A:
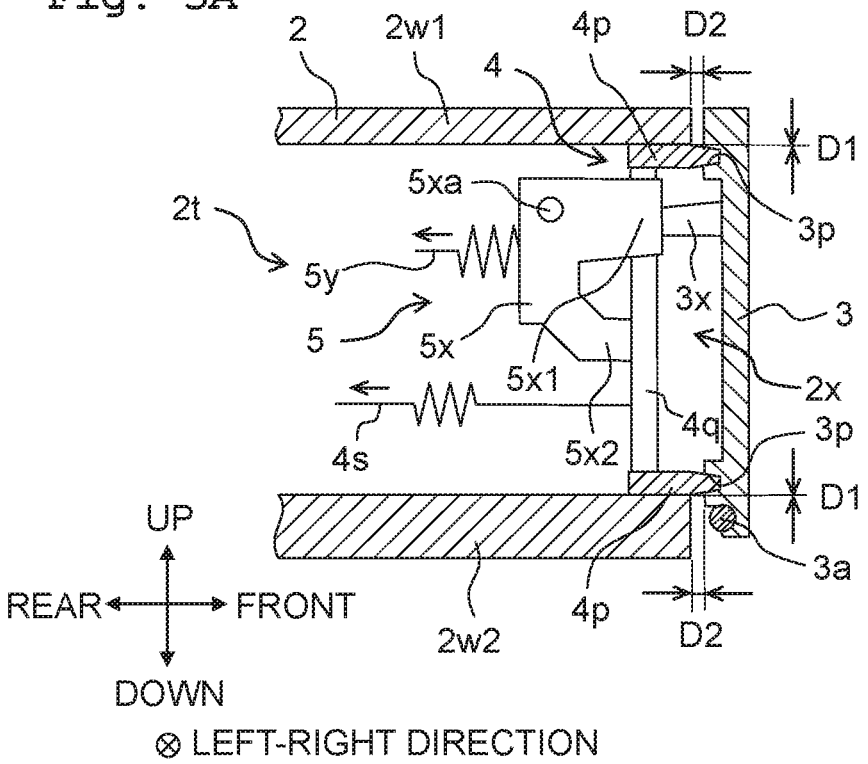
FIG. 3A is a cross-sectional view taken along a line IIIA-IIIA of FIG. 2.
Figure 3B:
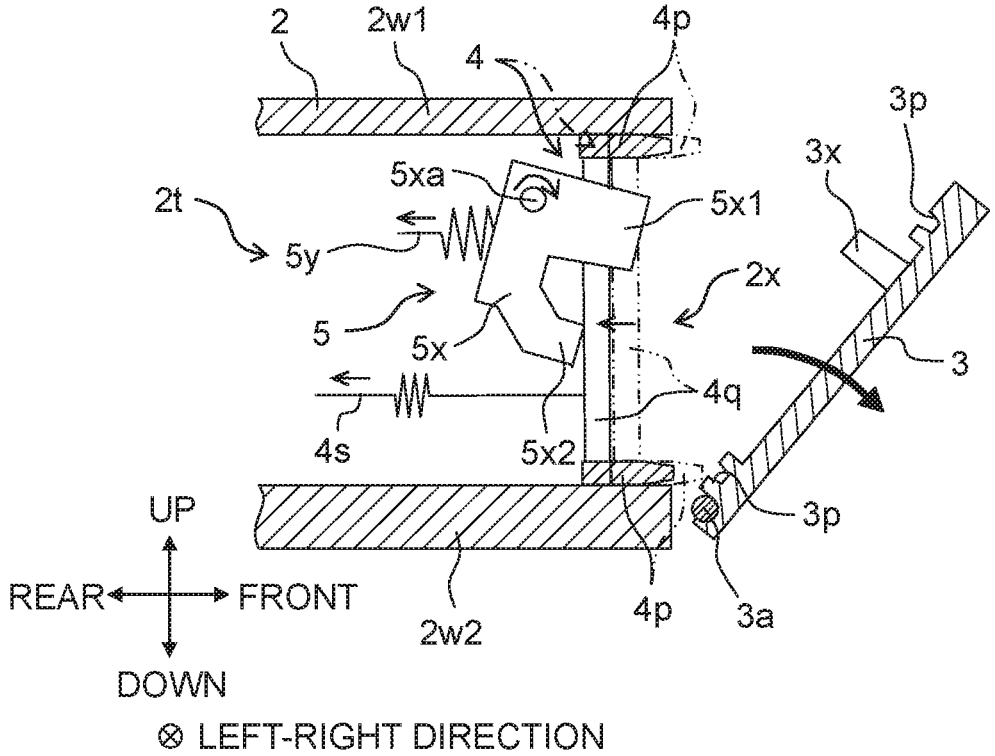
FIG. 3B is a cross-sectional view depicting a state in which the cover has pivoted frontward from a state of FIG. 3A.

Referring to FIG. 2 to FIG. 3B, configurations of the casing 2 and the cover 3 will be explained in detail. FIGS. 3A and 3B omit an illustration of the tank T.

As depicted in FIG. 3A, a front end of the tank storing part 2*t* of the casing 2 is provided with a moving member 4. The moving member 4 includes a support part 4*q* extending in an up-down direction and a protrusion 4*p* supported by upper and lower ends of the support part 4*q* and protruding frontward from the support part 4*q*. The support part 4*q* is disposed at a right end of the tank storing part 2*t* in a state of being urged rearward by use of a spring 4*s*. As depicted in FIG. 2, the protrusion 4*p* surrounds the whole circumference of the opening 2*x*. The support part 4*q* is made from a rigid material (resin or the like) and the protrusion 4*p* is made from an elastic material (rubber or the like). The protrusion 4*p* is in tight contact with respective walls (i.e., an upper wall 2*w*1, lower wall 2*w*2, and left and right walls) defining the opening 2*x* of the casing 2 without space therebetween.

An inner surface of the cover 3, which faces inside of the casing 2 when the cover 3 is in the closed position, is formed with a recess 3*p* having a shape corresponding to the protrusion 4*p* and into which the protrusion 4*p* is to be fitted. As depicted in FIG. 3A, when the cover 3 is in the closed position, the protrusion 4*p* is fitted into the recess 3*p*. This keeps the cover 3 in the closed position to prevent pivoting of the cover 3. Namely, the moving member 4 includes the protrusion 4*p* as an engaging part that engages with the cover 3 in the closed position to prevent the pivoting of the cover 3. When the cover 3 is in the closed position, the protrusion 4*p* is fitted into the recess 3*p* such that the protrusion 4*p* is in tight contact with the respective walls defining the opening 2*x*. This airtightly covers the opening 2*x* to seal the tank storing part 2*t* in the casing 2. In that configuration, a gap D1 between the protrusion 4*p* and the casing 2 in the up-down direction is substantially zero, which is smaller than a gap D2 between the cover 3 and the casing 2 in a front-rear direction.

The casing 2 includes a movement mechanism 5 that moves the moving member 4 relative to the casing 2 in the front-rear direction. Similarly to the support part 4*q*, the movement mechanism 5 is disposed at the right end of the tank storing part 2*t*. The movement mechanism 5 includes a pivoting member 5*x* that pivots around a pivoting shaft 5*xa* extending in the left-right direction; and a spring 5*y* that urges the pivoting member 5*x* in a clockwise direction of FIG. 3A. The pivoting member 5*x* includes two protrusions 5*x*1 and 5*x*2 protruding frontward. The protrusion 5*x*1 is positioned on the left of the support part 4*q*. The protrusion 5*x*2, which overlaps in the left-right direction with the support part 4*q*, is constantly in contact with the support part 4*q*. As depicted in FIG. 3A, when the cover 3 is in the closed position, a front end surface of the protrusion 5*x*1 is in contact with an end surface of a protrusion 3*x* provided in the inner surface of the cover 3, and a front end surface of the protrusion 5*x*2 is in contact with a rear surface of the support part 4*q*.

Subsequently, opening and closing operations of the cover 3 will be explained.

When opening the cover 3 in the closed position, the user pivots the cover 3 from the closed position to the opened position (in a direction indicated by a thick arrow in FIG. 3B) while holding the handle 3*h*. In an early stage of this pivoting (when the cover 3 has started the pivoting from the closed position to the opened position), the protrusion 3*x* separates from the protrusion 5*x*1, which causes the pivoting member 5*x* to pivot in the clockwise direction of FIG. 3B by the aid of the urging force of the spring 5*y*. This moves the protrusion 5*x*2 rearward, moves the support part 4*q* rearward together with the protrusion 5*x*2 by the aid of the urging force of the spring 4*s*, and consequently moves the whole moving member 4 rearward. Accordingly, the moving member 4 moves from an engagement position depicted in FIG. 3A to a release position depicted in FIG. 3B. In other words, the movement mechanism 5 moves the moving member 4 from the engagement position to the release position in association with the pivoting of the cover 3 from the closed position to the opened position.

In the engagement position, the protrusion 4*p* is fitted into the recess 3*p* to prevent the pivoting of the cover 3. In the release position, the protrusion 4*p* is released from the recess 3*p* to allow the pivoting of the cover 3.

For example, when the user closes the cover 3 after disposing the tank T in the tank storing part 2*t* with the cover 3 kept in opened position, the user pivots the cover 3 from the opened position to the closed position (in a direction opposite to the thick arrow direction of FIG. 3B) while holding the handle 3*h*. In a latter stage of this pivoting (immediately before the cover reaches the closed position), the protrusion 3*x* makes contact with the protrusion 5*x*1 to push the protrusion 5*x*1 rearward. This causes the pivoting member 5*x* to pivot in a counterclockwise direction of FIG. 3B against the urging force of the spring 5*y*. The pivoting of the pivoting member 5*x* pushes the protrusion 5*x*2 frontward to move the support part 4*q* frontward against the urging force of the spring 4*s*. This moves the whole moving member 4 frontward from the release position depicted in FIG. 3B to the engagement position depicted in FIG. 3A. In other words, the movement mechanism 5 moves the moving member 4 from the release position to the engagement position in association with the pivoting of the cover 3 from the opened position to the closed position.

As described above, in the first embodiment, engaging the protrusion 4*p* with the cover 3 in the closed position prevents the entrance of foreign matter and ink leakage through the opening 2*x* (see FIG. 3A). Further, causing the movement mechanism 5 to move the moving member 4 from the engagement position (see FIG. 3A) to the release position (see FIG. 3B) facilitates the pivoting of the cover 3.

In the release position, the protrusion 4*p* is released from the recess 3*p* (see FIG. 3B). This facilitates the opening and closing operations of the cover 3.

The movement mechanism 5 moves the moving member 4 from the engagement position (see FIG. 3A) to the release position (see FIG. 3B) in association with the pivoting of the cover 3 from the closed position to the opened position. In that case, moving the moving member 4 from the engagement position to the release position independently of control of a controller facilitates the pivoting of the cover 3 without requiring a complex electrical configuration.

The movement mechanism 5 moves the moving member 4 from the release position (see FIG. 3B) to the engagement position (see FIG. 3A) in association with the pivoting of the cover 3 from the opened position to the closed position. In that case, moving the moving member 4 from the release position to the engagement position independently of control of the controller prevents the entrance of foreign matter and ink leakage through the opening 2*x* without requiring a complex electrical configuration.

The opening 2*x* is formed in a side surface of the casing 2 (see FIG. 1). This enables the user to exchange the cartridge-type tank T easily.

The movement mechanism 5 moves the moving member 4 in a direction orthogonal to a surface of the casing 2 formed with the opening 2*x* (an exemplary first direction, see FIGS. 3A and 3B). The moving member 4 can be moved by the simply-configured movement mechanism 5.

Fitting the protrusion 4*p* of the moving member 4 into the recess 3*p* of the cover 3 keeps the cover 3 in the closed position (see FIG. 3A). This reliably prevents the entrance of foreign matter and ink leakage through the opening 2*x*.

The protrusion 4*p* surrounds the whole circumference of the opening 2*x* (see FIG. 2). This reliably prevents the entrance of foreign matter and ink leakage through the opening 2*x* when the cover 3 is in the closed position.

When the moving member 4 is in the engagement position and the cover 3 is in the closed position (see FIG. 3A), the gap D1 between the protrusion 4*p* and the casing 2 in the up-down direction (a direction parallel to the surface of the casing 2 formed with the opening 2*x*, an exemplary second direction) is smaller than the gap D2 between the cover 3 and the casing 2 in the front-rear direction (the direction orthogonal to the surface of the casing 2 formed with the opening 2*x*). This reliably prevents the entrance of foreign matter and ink leakage through the opening 2*x*.

When the moving member 4 is in the engagement position, the protrusion 4*p* is in contact with the casing 2 (see FIG. 3A). This reliably prevents the entrance of foreign matter and ink leakage through the opening 2*x*.

The protrusion 4*p* is made from an elastic material, resulting in the configuration in which the protrusion 4*p* is in tight contact with the casing 2 without space therebetween.

Second Embodiment

Figure 4:
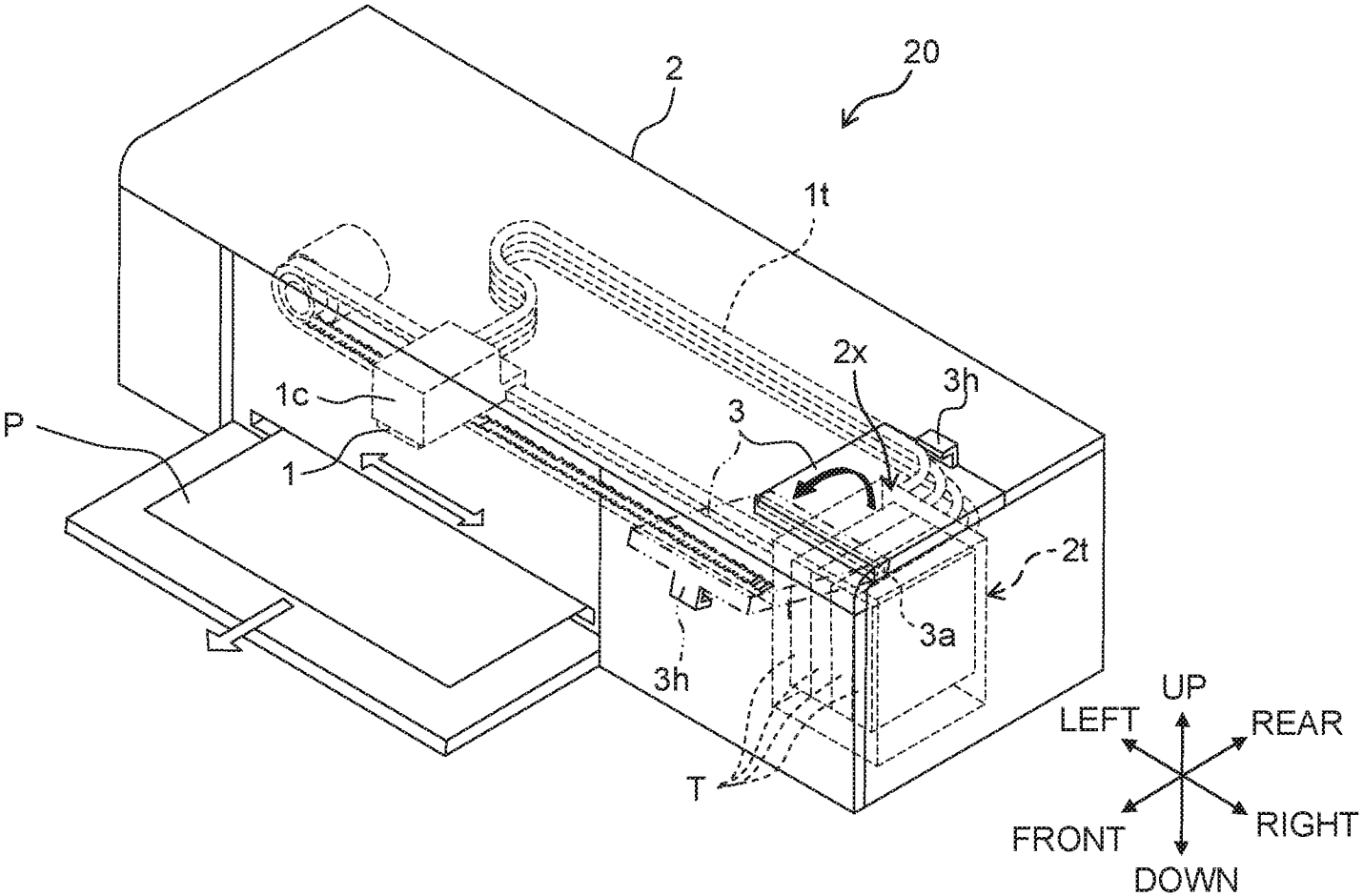
FIG. 4 is a perspective view of a printer according to a second embodiment of the present teaching.

Subsequently, referring to FIG. 4, a printer 20 according to a second embodiment of the present teaching will be explained.

The printer 20 of the second embodiment is different from the printer 10 of the first embodiment in that the opening 2*x* is formed in an upper surface of the casing 2 rather than the side surface and that respective tanks T stored in the tank storing part 2*t* are of an ink replenishment-type rather than the cartridge-type.

In the second embodiment, the opening 2*x* is formed in the upper surface of the casing 2, and thus the movement mechanism 5 moves the moving member 4 in the up-down direction (the direction orthogonal to the surface of the casing 2 formed with the opening 2*x*).

Since the configuration of the printer 20 is the same as the printer 10 of the first embodiment except for the above-described features, the printer 20 can obtain the similar effects to those of the printer 1. Further, since the opening 2*x* is formed in the upper surface of the casing 2, the user can easily replenish the ink replenish-type tank T with ink.

Third Embodiment

Figure 5A:
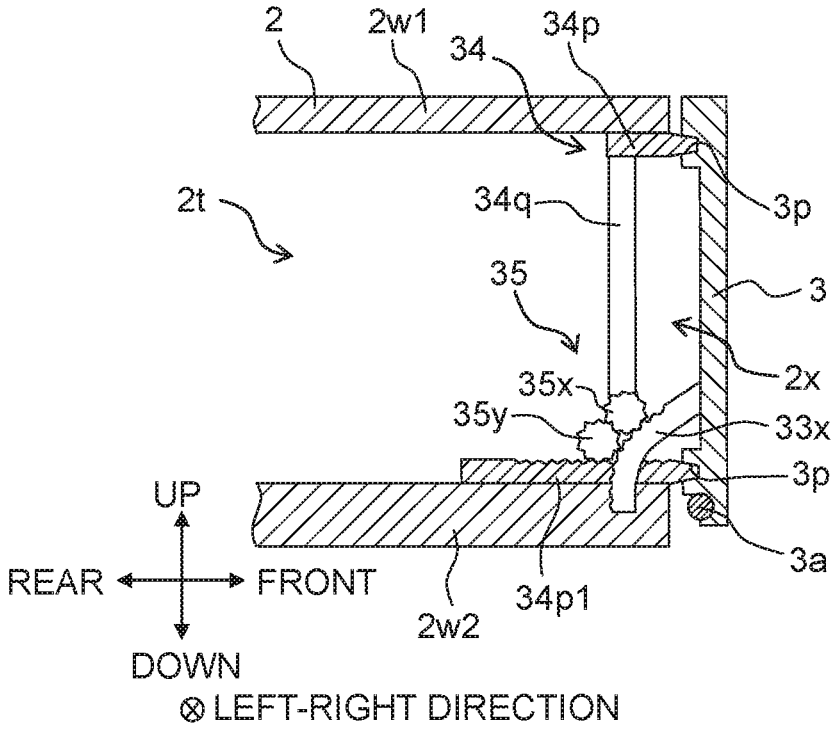
FIG. 5A is a cross-sectional view of a printer according to a third embodiment of the present teaching that corresponds to FIG. 3A.
Figure 5B:
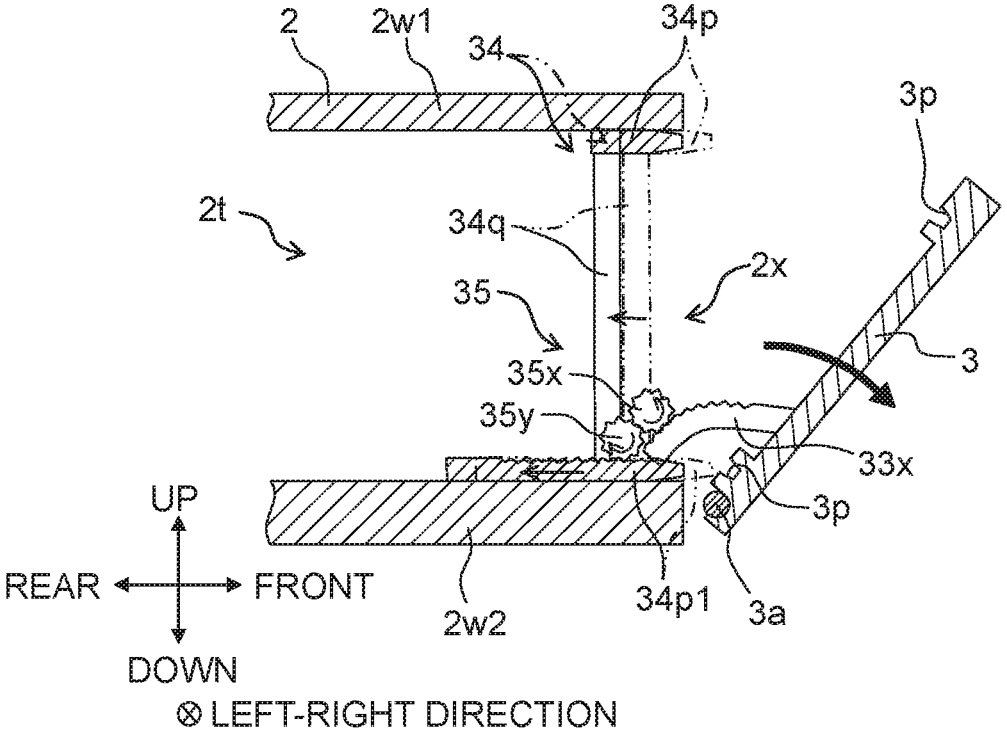
FIG. 5B is a cross-sectional view depicting a state in which the cover has pivoted frontward from a state of FIG. 5A.

Subsequently, referring to FIGS. 5A and 5B, a printer according to a third embodiment of the present teaching will be explained. FIGS. 5A and 5B omit an illustration of the tank T.

The printer of the third embodiment has a moving member and a movement mechanism different from those of the printer 10 of the first embodiment.

In the third embodiment, a moving member 34 includes a support part 34*q* extending in the up-down direction and a protrusion 34*p* supported by upper and lower ends of the support part 34*q* and protruding frontward from the support part 34*q*. The support part 34*q* is disposed at a right end of the tank storing part 2*t*. The protrusion 34*p* surrounds the whole circumference of the opening 2*x*. A lower protrusion 34*p*1 of the protrusion 34*p* extending along a lower side of the opening 2*x* protrudes also rearward from the support part 34*q*. An upper surface of the lower protrusion 34*p*1 is formed with racks. The support part 34*q* is made from a rigid material (resin or the like) and the protrusion 34*p* is made from an elastic material (rubber or the like). The protrusion 34*p* is in tight contact with respective walls (i.e., the upper wall 2*w*1, lower wall 2*w*2, and left and right walls) defining the opening 2*x* of the casing 2 without space therebetween.

In the third embodiment, a movement mechanism 35 includes two gears 35*x* and 35*y*. The gears 35*x* and 35*y* are disposed at a right end of the tank storing part 2*t*. The gear 35*x* engages with the gear 35*y* and a rack member 33*x* provided in the inner surface of the cover 3. The gear 35*y* engages with the gear 35*x* and the racks provided in the lower protrusion 34*p*1.

Subsequently, the opening and closing operations of the cover 3 will explained.

When opening the cover 3, the user pivots the cover 3 from the closed position to the opened position (a direction indicated by a thick arrow in FIG. 5B) while holding the handle 3*h*. In that situation, the gear 35*x* rotates in a counterclockwise direction in FIG. 5B along with the movement of the rack member 33*x*. The rotation of the gear 35*x* is transmitted to the gear 35*y*, rotating the gear 35*y* in a clockwise direction in FIG. 5B. In association with the rotation of the gear 35*y*, the lower protrusion 34*p*1 moves rearward, thus moving the whole moving member 34 rearward. Accordingly, the moving member 34 moves from the engagement position depicted in FIG. 5A to the release position depicted in FIG. 5B. In other words, the movement mechanism 35 moves the moving member 34 from the engagement position to the release position in association with the pivoting of the cover 3 from the closed position to the opened position.

For example, when the user closes the cover 3 after disposing the tank T in the tank storing part 2*t* with the cover 3 kept in opened position, the user pivots the cover 3 from the opened position to the closed position (in a direction opposite to the thick arrow direction in FIG. 5B) while holding the handle 3*h*. In that situation, the gear 35*x* rotates in the clockwise direction in FIG. 5B along with the movement of the rack member 33*x*. The rotation of the gear 35*x* is transmitted to the gear 35*y*, rotating the gear 35*y* in the counterclockwise direction in FIG. 5B. In association with the rotation of the gear 35*y*, the lower protrusion 34*p*1 moves frontward, thus moving the whole moving member 34 frontward. Accordingly, the moving member 34 moves from the release position depicted in FIG. 5B to the engagement position depicted in FIG. 5A. In other words, the movement mechanism 35 moves the moving member 34 from the release position to the engagement position in association with the pivoting of the cover 3 from opened position to the closed position.

Since the configuration of the printer of the third embodiment is the same as the printer 10 of the first embodiment except for the above-described features, the printer of the third embodiment can obtain the similar effects to those of the printer 1.

In the above description, the embodiments of the present teaching have been explained. The present teaching, however, is not limited to those embodiments. Various design changes are possible without departing from the description of the appended claims.

The opening may be formed in any surface of the casing, for example, in a lower surface of the casing. The engaging part is not limited to the protrusion fitting into the recess of the cover, and it may be a recess into which a protrusion of the cover is to be fitted. The engaging part may include both the protrusion and the recess. The engaging part may not surround the whole circumference of the opening, and it may surround a part of the opening. The engaging part may not be made from the elastic material, and it may be made from a rigid material. When the moving member is in the engagement position, the engaging part may not be in contact with the casing. The moving member and the movement mechanism may not be disposed in the tank storing part, and they may be disposed in any position (e.g., the outside of the walls defining the opening of the casing). The movement mechanism may move the moving member in a direction different from the direction orthogonal to the surface of the casing formed with the opening (e.g., the direction parallel to the surface of the casing formed with the opening). The movement mechanism may not move the moving member in association with the pivoting of the cover, and it may move the moving member independently of the pivoting of the cover. The movement of the moving member between the engagement position and the release position and the pivoting of the cover may not be manually performed by the user, and they may be performed by control of the controller. The present teaching may be applicable to facsimile machines, copy machines, multifunction peripherals, and the like without limited to the printers.

What is claimed is:

1. A liquid jetting apparatus, comprising:

a liquid jetting unit configured to jet liquid;

a casing including a tank storing part in which a tank containing the liquid to be supplied to the liquid jetting unit is stored, and having an opening through which the tank storing part communicates with an outside of the casing;

a cover pivotally attached to the casing and selectively positioned in a closed position where the opening is closed and an opened position where the opening is open, a moving member movably attached to the casing and including an engaging part configured to engage with the cover in the closed position to prevent pivoting of the cover; and a movement mechanism configured to move the moving member relative to the casing between an engagement position where the engaging part is engaged with the cover in the closed position to prevent the pivoting of the cover and a release position where the pivoting of the cover is not prevented, wherein the movement mechanism is configured to move the moving member from the engagement position to the release position in response to pivotal movement of the cover from the closed position to the opened position, and wherein the movement mechanism is configured to move the moving member from the release position to the engagement position in response to pivotal movement of the cover from the opened position to the closed position.

2. The liquid jetting apparatus according to claim 1, wherein in the release position, the engaging part is released from the cover in the closed position.

3. The liquid jetting apparatus according to claim 1, wherein the movement mechanism is configured to move the moving member from the engagement position to the release position in association with the pivoting of the cover from the closed position to the opened position.

4. The liquid jetting apparatus according to claim 1, wherein the movement mechanism is configured to move the moving member from the release position to the engagement position in association with the pivoting of the cover from the opened position to the closed position.

5. The liquid jetting apparatus according to claim 1, wherein the opening is formed in a side surface of the casing.

6. The liquid jetting apparatus according to claim 1, wherein the opening is formed in an upper surface of the casing.

7. A liquid jetting apparatus comprising:

a liquid jetting unit configured to jet liquid;

a casing including a tank storing part in which a tank containing the liquid to be supplied to the liquid jetting unit is stored, and having an opening through which the tank storing part communicates with an outside of the casing;

a cover pivotally attached to the casing and selectively positioned in a closed position where the opening is closed and an opened position where the opening is open, a moving member movably attached to the casing and including an engaging part configured to engage with the cover in the closed position to prevent pivoting of the cover; and a movement mechanism configured to move the moving member relative to the casing between an engagement position where the engaging part is engaged with the cover in the closed position to prevent the pivoting of the cover and a release position where the pivoting of the cover is not prevented, wherein the movement mechanism is configured to move the moving member in a first direction orthogonal to a surface of the casing formed with the opening.

8. The liquid jetting apparatus according to claim 1, wherein the engaging part is at least one of a protrusion to be fitted in a recess formed in the cover and a recess into which a protrusion formed in the cover is to be fitted.

9. The liquid jetting apparatus according to claim 7, wherein the engaging part surrounds a whole circumference of the opening.

10. The liquid jetting apparatus according to claim 9, wherein, in a case that the moving member is in the engagement position and the cover is in the closed position, a gap between the engaging part and the casing in a second direction parallel to the surface of the casing formed with the opening is smaller than a gap between the cover and the casing in the first direction.

11. The liquid jetting apparatus according to claim 10, wherein, in a case that the moving member is in the engagement position, the engaging part is in contact with the casing.

12. The liquid jetting apparatus according to claim 11, wherein the engaging part is made from an elastic material.

* * * * *